United States Patent [19]

Graham

[11] 4,280,463

[45] Jul. 28, 1981

[54] FUEL SPRAY BAR FOR INTERNAL COMBUSTION ENGINE

[75] Inventor: Kenneth A. Graham, Birmingham, Mich.

[73] Assignee: Chrysler Corporation, Highland Park, Mich.

[21] Appl. No.: 83,086

[22] Filed: Oct. 9, 1979

[51] Int. Cl.[3] ..... F02M 29/00

[52] U.S. Cl. ..... 123/445; 123/590; 261/65; 261/DIG. 39

[58] Field of Search ..... 123/445, 456, 590, 472, 123/478; 261/65, 78 R, DIG. 39, DIG. 82, 67, 44 E, 44 R, 62

[56] References Cited

U.S. PATENT DOCUMENTS

| | | | |
|---|---|---|---|
| 1,855,383 | 4/1932 | Capell | 261/DIG. 39 |
| 1,893,920 | 1/1933 | Winfield | 261/44 E |
| 2,389,219 | 11/1945 | Thompson et al. | 261/44 E |
| 3,785,627 | 1/1974 | Tuzson et al. | 261/DIG. 39 |
| 3,834,679 | 9/1974 | Baribeau et al. | 261/DIG. 39 |
| 4,021,513 | 5/1977 | Ullman | 261/DIG. 39 |
| 4,065,526 | 12/1977 | Englert et al. | 261/DIG. 39 |
| 4,066,721 | 1/1978 | Graham | 261/65 |
| 4,132,204 | 1/1979 | Teague | 261/DIG. 39 |
| 4,139,583 | 2/1979 | Riley et al. | 261/65 |

*Primary Examiner*—Ira S. Lazarus
*Assistant Examiner*—Magdalen Moy
*Attorney, Agent, or Firm*—Newtson & Dundas

[57] ABSTRACT

An improved fuel spray bar for spraying fuel into the induction passage of an internal combustion engine comprises a pair of spray tubes projecting from a spray bar body into the induction passage with a fuel dispersion element downstream thereof. Each spray bar tube has a plurality of spray orifices spaced along the length thereof for spraying fuel in a direction generally downstream of the induction passage. The improvement of the invention is provided by arranging one of the spray bar tubes upstream of the other so as to spray fuel onto the upstream surface of said other spray bar tube.

1 Claim, 5 Drawing Figures

FUEL SPRAY BAR FOR INTERNAL COMBUSTION ENGINE

BACKGROUND AND SUMMARY OF THE INVENTION

This invention pertains to fuel dispersion systems for internal combustion engines and is particularly concerned with an improvement in a fuel spray bar for spraying fuel into the induction passage of an internal combustion engine.

For the purpose of achieving improved fuel economy and reduced exhaust emission products, it is desirable to improve the quality of the combustible fuel-air mixture by improved atomization of fuel. In U.S. Pat. No. 4,132,204 assigned to the same assignee as the present application there is disclosed a fuel spray bar and pressure regulator system which sprays liquid fuel into the induction passage of an internal combustion engine. Such a system is well suited for use in an electronic fuel metering system, such as shown in U.S. Pat. No. 3,935,851 also assigned to the same assignee as the present application.

In one respect the present invention is concerned with a fuel spray bar which constitutes an improvement upon the fuel spray bar disclosed in the former commonly assigned patent. One of the chief advantages of the present invention is that still further improvements in fuel atomization and distribution can be achieved.

The foregoing features, advantages and benefits along with additional ones, will be seen in the ensuing description and claims which should be considered in conjunction with the accompanying drawings. The drawings disclose a presently preferred embodiment of the invention according to the best mode presently contemplated in carrying out the invention.

DESCRIPTION OF THE PREFERRED EMBODIMENT

Figure 1:
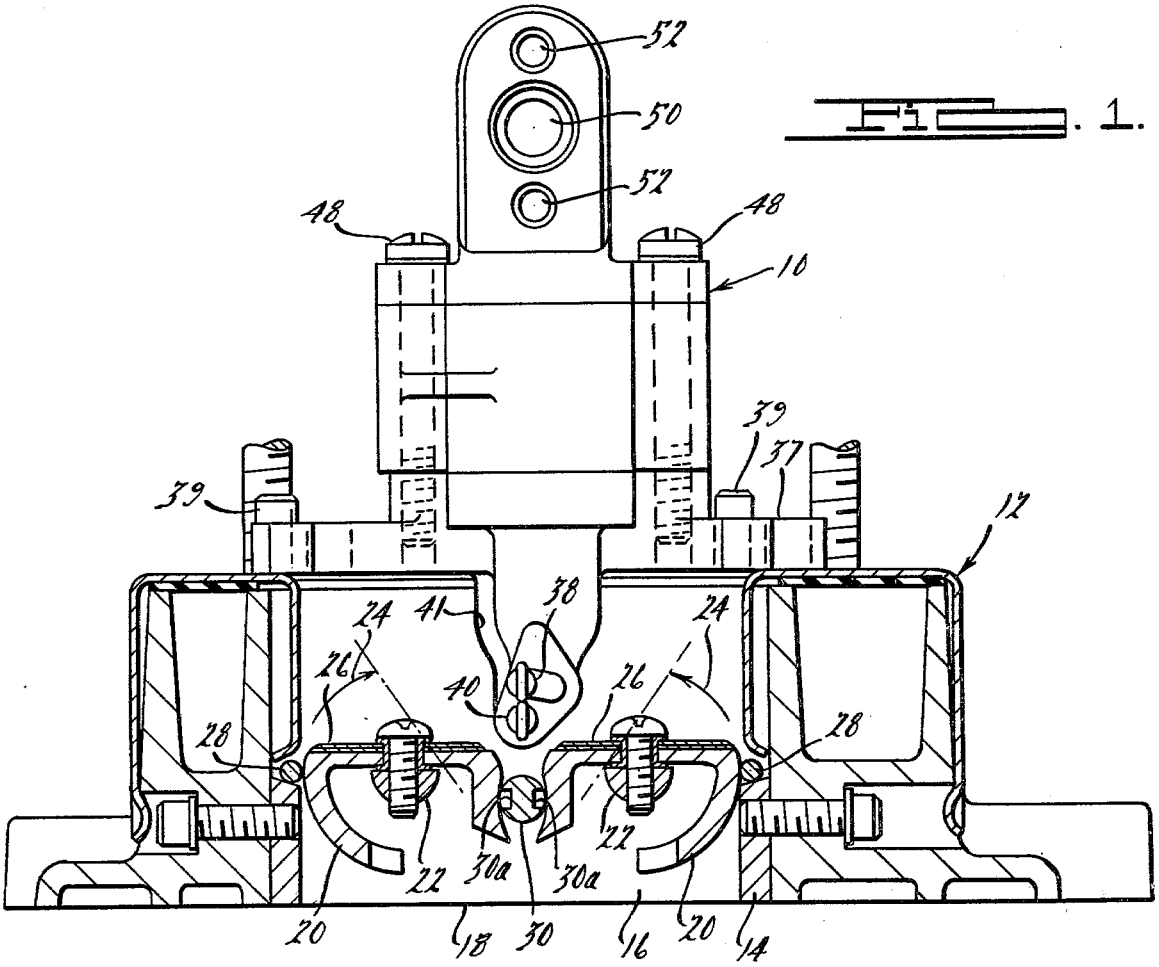
FIG. 1 is a front elevational view of engine structure, partly in section, illustrating a fuel spray bar and pressure regulator assembly containing the improvement of the present invention.
Figure 2:
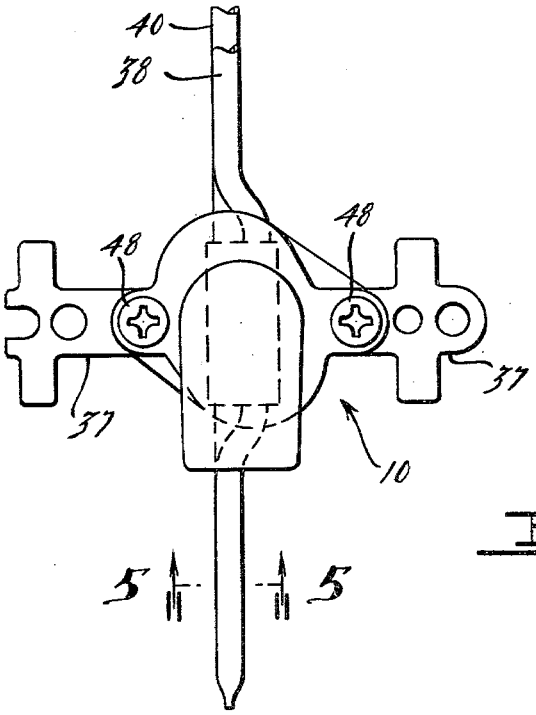
FIG. 2 is a top plan view of the fuel spray bar and pressure regulator assembly of FIG. 1 shown by itself.
Figure 3:
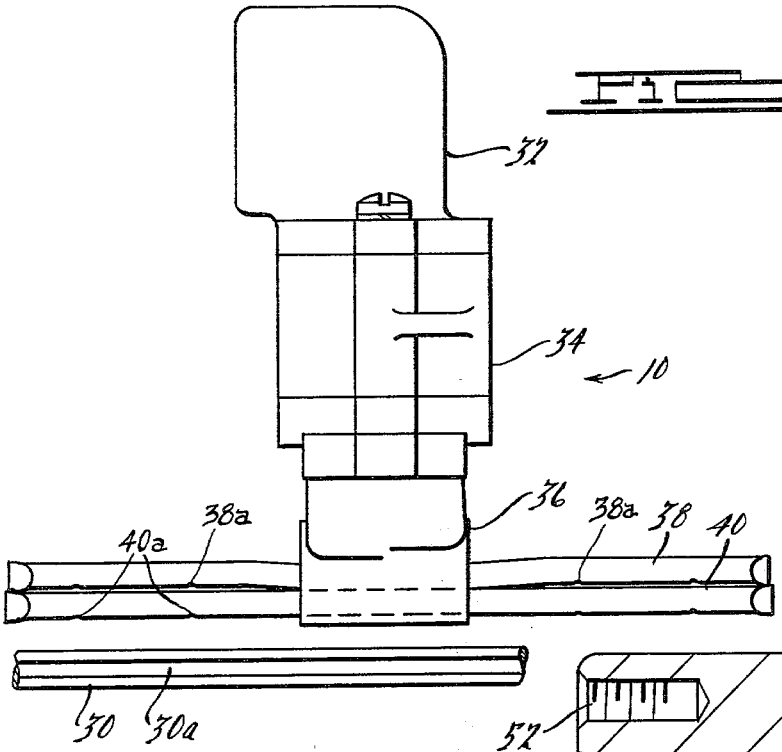
FIG. 3 is a right-side elevational view of the fuel spray bar and pressure regulator assembly of FIG. 3 shown by itself.
Figure 5:
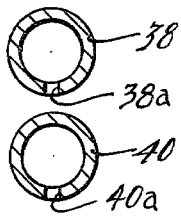
FIG. 5 is an enlarged sectional view taken in the direction of arrows 5—5 in FIG. 2.

In FIG. 1 a fuel spray bar and pressure regulator assembly generally designated by the reference numeral 10 is shown mounted on a throttle body assembly generally designated by the reference numeral 12. Throttle body assembly 12 is of the same general type shown in U.S. Pat. No. 4,132,204 and allowed U.S. application Ser. No. 860,296 and now U.S. Pat. No. 4,139,583 and hence will not be described in detail in the interest of brevity except insofar as details thereof not found in the aforementioned patent and patent application relate to the present invention. Although the invention is disclosed in connection with this type of throttle body assembly it will be appreciated that this type of throttle body assembly should not be considered as constituting a limitation upon the scope of the invention.

Briefly then, the throttle body assembly 12 comprises a throttle body 14 having a pair of rectangular shaped ports 16 which form a portion of the induction passage of the internal combustion engine with which the assembly is used. The two ports 16 are divided by a vertical partition 18 and it will be appreciated that as viewed in FIG. 1 the second port 16 lies behind the first port 16 which appears in that Figure. Disposed within each port 16 are a pair of counter-rotatable throttle blades 20 each of which is secured to a corresponding throttle shaft 22. The two shafts 22 are coupled for counter rotation in unison by appropriate mechanism (which is not shown in the drawing) so that when the throttle is actuated the blades counter-rotate as indicated by the arrows 24. An arrangement for sealing the blades with respect to the walls of the throttle body ports 16 includes wiper type seals 26 on the top of each blade and roller type seals 28. Details of this sealing arrangement can be found in the aforementioned allowed application Ser. No. 860,926 and will not be repeated herein the interest of brevity.

One difference of the throttle body structure which is not found in the U.S. Pat. No. 4,132,204 or application Ser. No. 860,926 is a dispersion element 30 which is located centrally of each induction port and which extends in each port from partition 18 across the port to the opposite wall. The juxtaposed edges of the throttle blade pairs are cooperatively arranged with respect to dispersion element 30 to vary the amount of opening between the edge of each blade and the dispersion element as the blades are rotated to thereby selectively throttle the induction passage. FIG. 1 illustrates the blades in the full closed position with the juxtaposed edges thereof bearing against the dispersion element along the full length of each port. The preferred form of dispersion element is a circular cylindrical bar having a pair of grooves 30*a* on opposite sides thereof to form sharp edges across which fuel is sheared. The dispersion element is more fully described in the commonly assigned application of Gordon W. Fenn, filed of even date.

Figure 4:
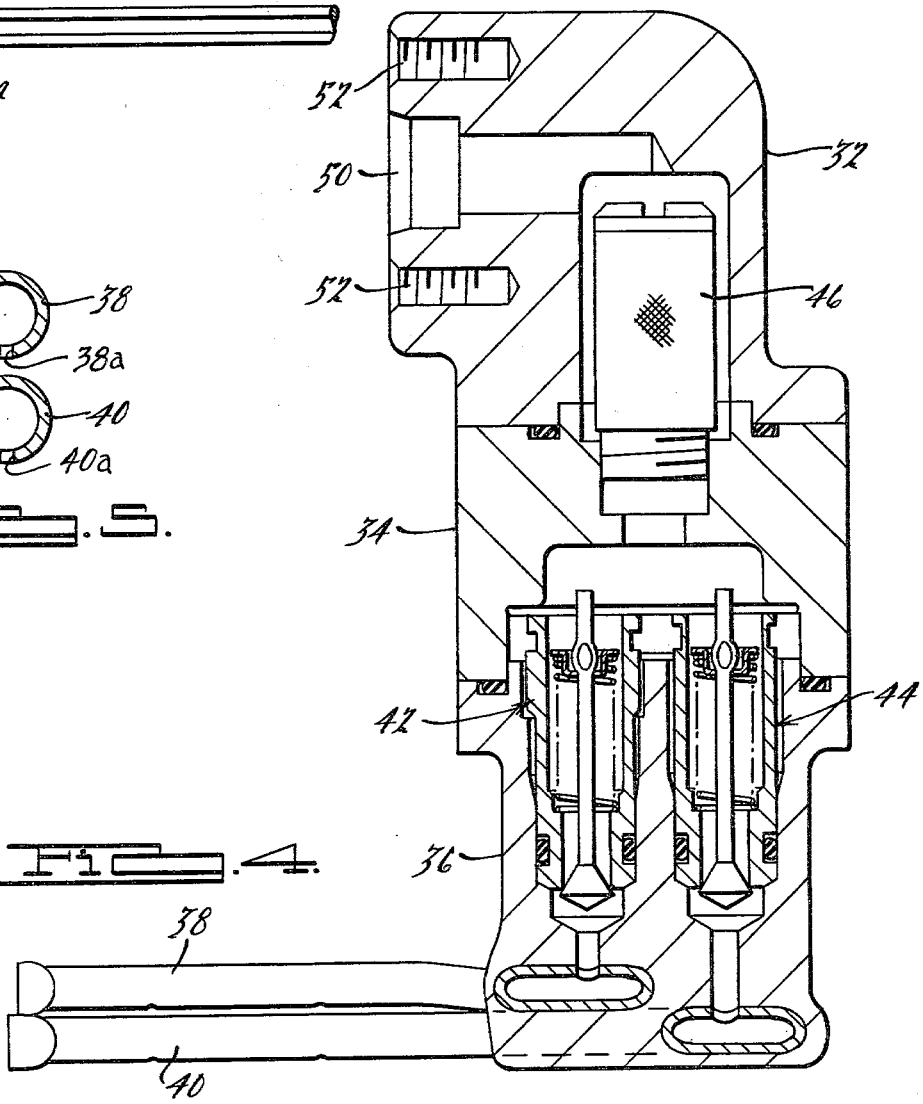
FIG. 4 is a view similar to FIG. 3 on an enlarged scale and partly in section.

Therefore, now turning to details of spray bar and pressure regulator assembly 10, it can be seen (perhaps best in FIG. 4) that the assembly 10 comprises several different sections. There is a three-piece body section comprising body elements 32, 34, 36, a pair of spray bar tubes 38, 40, a pair of regulator valve assemblies 42, 44, and a filter element 46. As shown in FIG. 1, body element 36 includes a mounting flange 37 which provides for mounting of the assembly on the top of partition 18 by means of fasteners 39 on opposite sides of the assembly. A suitable recess 41 is provided centrally in partition 18 so that the depending portion of body element 36 can be received therein. The spray bars 38 and 40 are disposed perpendicular to the main vertical axis of the assembly so that when the assembly 10 is mounted on throttle body assembly 12 the two spray bars 38 and 40 are disposed upstream of and parallel to dispersion element 30. The three body elements 32, 34 and 36 are assembled together by means of a pair of bolts 48 with the two valve assemblies 42, 44 being retained between elements 34 and 36 and filter 46 between the two elements 32 and 34. The inlet to assembly 10 is designated by the reference numeral 50 and is provided in body element 32. Inlet 50 provides for attachment of a fuel supply line to assembly 10 with the adjacent tapped holes 52 providing for attachment of the supply line. As shown in FIG. 4 a fuel passage is provided through assembly 10 from inlet 50 with filter 46 serving to filter out particles and contaminants before they can reach the valve assemblies 42 and 44. As explained in the above U.S. Pat. No. 4,132,204, the two valve assemblies 42, 44, are set to control fuel to the spray bar tubes 38 and 40, respectively, as a function of the pressure of fuel supplied to the inlet 50. In the present embodiment, valve 44 is designed to open at a lower pressure than is valve 42. Hence, valve 44 is referred to as the low pressure regulator valve and spray bar tube 40 as the low pressure fuel rail. Valve 42 is the high pressure regulator valve and spray bar tube 38 is the high pressure fuel rail. Each spray bar tube 38, 40 comprises a plurality of spray orifices 38*a*, 40*a* respectively, disposed at spaced locations along the lengths thereof. In the disclosed embodiment each spray bar comprises four spray orifices, two each on each side of the body section 36 to thereby provide two spray orifices each for each rail in each port.

Under light and moderate engine loads valve 44 is open and valve 42 is closed. This means that under these conditions fuel is sprayed into the induction passage only by means of spray bar tube 40. As can be seen in FIG. 1, spray bar 40 is poised directly above fuel dispersion bar 30 to spray fuel directly onto the concave upper surface of the dispersion bar. The grooves 30*a* provided on opposite sides of the dispersion bar for the full length thereof define sharp edges off of which the fuel sprayed onto the dispersion bar is sheared by induction air passing across the dispersion bar. This is beneficial in promoting improved fuel atomization.

The present invention resides in positioning tube 38 slightly upstream of tube 40 a distance less than the spacing between tube 40 and dispersion element 30. Thus, when the high pressure rail sprays fuel from its spray orifices, the fuel impinges directly onto the concave upstream surface of the low pressure rail. Because the high pressure rail sprays fuel only at high engine loads where the throttle blades will be at or near their maximum open position, it does not interfere with the operation of the low pressure rail and dispersion element at light and moderate engine loads where the blades are only partly open and only the low pressure rail sprays fuel. At high engine loads the effectiveness of dispersion element 30 may not be as great as at lesser loads, and therefore by having the high pressure rail spray fuel onto the low pressure rail, any loss of effectiveness of dispersion element 30 tends to be compensated thereby achieving an overall improvement in atomization and distribution of fuel mixture with induction air under high power conditions.

By disposing the upper spray bar directly in line with the lower spray bar and thereby having both in line with the dispersion element, symmetry is attained between the two blades of each counter-rotatable pair. This results in more uniform distribution between each blade and the dispersion element and represents an improvement upon the spray arangement shown in U.S. Pat. No. 4,132,204, referred to above. The arrangement also possesses the advantage of being compact and economical to fabricate.

What is claimed is:

1. In an internal combustion engine having structure defining an induction passage and a spray bar unit for spraying fuel into the induction passage wherein the spray bar unit comprises a body, a pair of spray tubes projecting from the body into the induction passage, said spray tubes each comprising a plurality of spray orifices spaced along the length and on the downstream side thereof for spraying fuel in a direction generally downstream of the induction passage, means for supplying fuel via said body through the spray tubes for spraying via said orifices into the induction passage and a dispersion element disposed in said passage transverse to the direction of flow through said induction passage downstream of said spray tubes having a concave dispersion surface facing upstream of the passage and wherein one of said tubes is disposed spaced upstream of the induction passage from the dispersion element and arranged so that its orifices cause fuel sprayed therefrom to impinge upon the upstream concave surface of the dispersion element, the improvement characterized in that the other spray tube is disposed slightly spaced upstream of the induction passage relative to the one tube and arranged so that its orifices spray fuel to impinge upon the upstream surface of the wall of said one tube, said other tube being spaced upstream of said one tube a distance which is less than the distance by which said one tube is spaced upstream of said dispersion member, said other tube spraying fuel onto said one tube only during conditions requiring increased engine power.

* * * * *